US012037725B2

(12) United States Patent
Simionescu

(10) Patent No.: US 12,037,725 B2
(45) Date of Patent: Jul. 16, 2024

(54) YARN TENSIONING DEVICE

(71) Applicant: Petru Aurelian Simionescu, Corpus Christi, TX (US)

(72) Inventor: Petru Aurelian Simionescu, Corpus Christi, TX (US)

(73) Assignee: Texas A&M University Corpus Christi, Corpus Christi, TX (US)

( * ) Notice: Subject to any disclaimer, the term of this patent is extended or adjusted under 35 U.S.C. 154(b) by 212 days.

(21) Appl. No.: 17/405,995

(22) Filed: Aug. 18, 2021

(65) Prior Publication Data

US 2023/0053628 A1 Feb. 23, 2023

(51) Int. Cl.
*D04C 3/14* (2006.01)
*D04B 15/44* (2006.01)

(52) U.S. Cl.
CPC ..... *D04C 3/14* (2013.01); *D04B 15/44* (2013.01)

(58) Field of Classification Search
CPC ... D04C 3/14; D04C 3/18; D04C 3/16; D04C 3/20; D04C 3/46; D04C 3/48; D04B 15/44; D04B 27/12; D04B 15/40; D04B 15/38; D03J 5/24; B65H 59/00
See application file for complete search history.

(56) References Cited

U.S. PATENT DOCUMENTS 530,873 A * 12/1894 Wolferts ..... D04C 3/14 87/56
917,424 A * 4/1909 Edwards ..... D04C 3/14 87/22
1,595,380 A * 8/1926 Carl ..... D04C 3/18 87/22
1,900,952 A * 3/1933 Robinson ..... D04C 3/38 87/22
1,940,498 A * 12/1933 Johnson ..... D04C 3/18 87/55
2,459,617 A * 1/1949 Carter ..... D04C 3/14 242/419.1
3,604,414 A * 9/1971 Borges ..... A61B 17/8019 606/105
3,797,279 A * 3/1974 Kline ..... D04B 15/38 66/146
5,975,557 A * 11/1999 Snoke ..... A63C 10/04 280/611

* cited by examiner

*Primary Examiner* — Khoa D Huynh
*Assistant Examiner* — Uyen T Nguyen

(57) ABSTRACT

A yarn tensioning device capable of delivering yarn under tension from a spool to a braiding, weaving or knitting machine consisting of a base and a center rod mounted perpendicular to the said base serving to locates the spool while allowing it to pivotally rotate. The device further includes a pawl jointed to the base either via a pin joint or via a flexural hinge and operates in conjunction with a ratchet solidly attached to the spool. The device further includes a compliant yarn guiding means which ensure that yarn reels off at an essentially constant tension. The yarn reel-off tension can be adjusted by modifying the operating length of a stiffening spring using a screw and jam-nut pair, and by limiting the maximum deflection of the compliant yarn guiding means.

1 Claim, 2 Drawing Sheets

YARN TENSIONING DEVICE

BACKGROUND—PRIOR ART

The following is a tabulation of some prior art that presently appears relevant

| Number | Kind Code | Issue Date | Patentee |
|---|---|---|---|
| 1,052,215 | A | Feb. 4, 1913 | Chace |
| 1,517,840 | A | Dec. 2, 1924 | Koella |
| 2,619,001 | A | Nov. 25, 1952 | Chace |
| 2,933,971 | A | Apr. 26, 1960 | Jeannotte and Silver |
| 3,045,526 | A | Jul. 24, 1962 | Harris |
| 3,107,576 | A | Oct. 22, 1963 | Carter |
| 3,276,310 | A | Oct. 4, 1966 | Radlauer |
| 3,324,757 | A | Jun. 13, 1967 | Richardson |
| 4,574,679 | A | Mar. 11, 1986 | Lasher |
| 4,788,898 | A | Dec. 6, 1988 | Bull |
| 5,904,087 | A | May 18, 1999 | Freitas et al. |
| 7,464,633 | B1 | Dec. 16, 2008 | Kao |

NONPATENT LITERATURE DOCUMENTS

G. Ma, D. J. Branscomb and D. G. Beale (2012) "Modeling of the tensioning system on a braiding machine carrier," Mechanism and Machine Theory, Vol. 47, January 2012, pages 46-61.

A. R. Labanieh, X. Legrand, V. Koncar and D. Soulat (2016) "Development in the multiaxis 3D weaving technology", Textile Research Journal, Vol. 86, Issue 17, page 1869-1884.

1. TECHNICAL FIELD

This invention relates generally to a spool carrier for delivering yarn off a spool to a braiding machine and other similar weaving and knitting equipment, and more particularly to a yarn tensioning device that can be easily manipulated to adjust the tension at which yarn is reeled off the spool.

2. BACKGROUND ART

Spool carriers for braiding machines and other similar weaving and knitting equipment are well-known in the art. In general, the known yarn tensioning devices suffer from being complicated in design. Another disadvantage of the known yarn tensioning devices is that, in order to adjust the tension upon which carrier reels off yarn from the spool, the carrier needs to be disassembled for changing one or more springs, further requiring the availability of an assortment of springs of different lengths and stiffnesses.

3. OBJECTS AND SUMMARY OF THE PRESENT INVENTION

It is the object of the present invention to provide a yarn tensioning device that has a simple design, and in addition can be easily adjusted for the tension at which yarn is reeled off the spool.

These and other objects are obtained in accordance with the present invention wherein there is provided a yarn tensioning device capable of delivering yarn under tension from a spool to a braiding, weaving or knitting machine consisting of a base, a center rod mounted perpendicular to the said base, and axially retaining means which locate the spool while allowing it to pivotally rotate about said center rod. The yarn tensioning device according to the present invention further includes a yarn tensioning means for providing tension to the yarn and for reeling off yarn from the spool upon reaching a predetermined amount of tension. Yarn tensioning means consists of a pawl jointed to the base either via a pin joint or via a flexural hinge and a pawl stiffening spring, said pawl working in conjunction with a ratchet solidly attached to the spool. Said yarn tensioning means further includes compliant yarn-guiding means which together with the pawl and its stiffening spring ensure that yarn reels off at an essentially constant tension. Yarn reel-off tension can be adjusted by modifying the operating length of the stiffening spring using a screw and jam-nut pair, and by limiting the maximum deflection of the compliant yarn guiding means.

4. BRIEF DESCRIPTION OF THE DRAWINGS

Further objects of the present invention will become apparent from the following description of the preferred embodiments with reference to the accompanying drawings in which.

5. DESCRIPTION OF THE PREFERRED EMBODIMENTS

Figure 1:
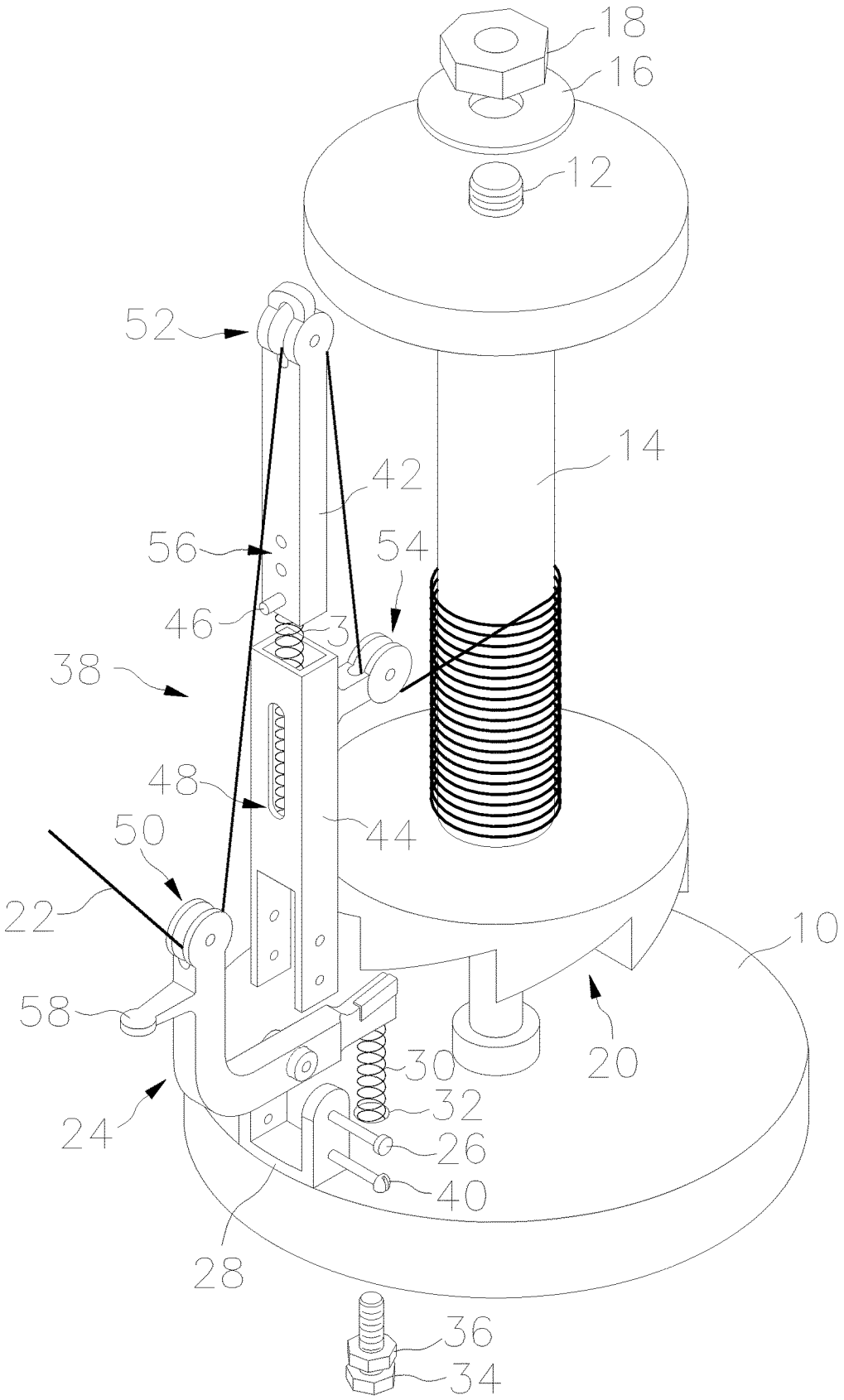
FIG. 1 is a perspective exploded view of one embodiment of the yarn tensioning device according to the present invention having a pawl jointed to the base via a pin joint, and being equipped a translating compliant yarn guiding means.

FIG. 1 shows a yarn tensioning device according to the present invention consisting of a base 10 upon which center rod 12 is attached. A spool 14 pivotally rotates about center rod 12 and it is axially located by the use of a washer 16 and a nut 18. Spool 14 is fitted at its lower end with a ratchet 20, and holds reeled a yarn 22. Ratchet 20 engages a pawl 24 which performs a rocking motion by means of a pin 26 and a clevis 28 which is solidly attached to base 10.

The engagement/disengagement of pawl 24 with ratchet 20 is controlled by the tension in yarn 22 as braiding or weaving actions are performed, and it is further conditioned by the upward push force developed by a stiffening spring 30. The lower end of stiffening spring 30 rests inside a hole 32, while its upper end rests against the active end of pawl 24. In order to control the force developed by stiffening spring 30, hole 32 is drilled through the entire thickness of base 10, it is threaded to the inside, and it is fitted from below with a screw 34 and a jam nut 36. In a manner known to a person of ordinary skill in the art, screw 34 and a jam nut 36 serve to adjust the amount of pre-compression of stiffening spring 30 by modifying the length said stiffening spring rests inside hole 32.

Additional effect upon the tension of yarn 22 is achieved by the action of a compliant yarn guiding means 38 mounted upon base 10 using clevis 28, pin 26 and a screw 40. Said complainant yarn guiding means consists of a strut 42, a hallow strut guide 44 and a compression spring 3, and relies for its operation upon a setscrew 46 which slides along a slot 48 practiced to the side of strut guide 44, and further relies upon pulleys 50, 52 and 54 mounted respectively on pawl 24, on strut 42 and on strut guide 44. Compression spring 3 extends through the inside of hallow strut guide 55 and rests its lower end against pawl 24. Yarn 22 is looped around said pulleys 50, 52 and 54, and when tensioned, it causes strut 42 to slides to the inside of strut guide 44 and act upon compression spring 3. When setscrew 46 bottoms slot 48 and thus strut 42 reaches the end of its travel, pawl 24 pivots about pin 26 and disengages ratchet 20, causing yarn 22 to reel off spool 14. To anticipate or delay the amount of travel of strut 42 before setscrew 46 bottoms slot 48, a plurality of threaded holes 56 are provided on the side of strut 42 where setscrew 46 can selectively be mounted.

For the purpose of manipulating spool 14 when setting the braiding or weaving machine, a lifting tab 58 is provided that is solidly attached to pawl 24 in the vicinity of pulley 50.

* * *

Figure 2:
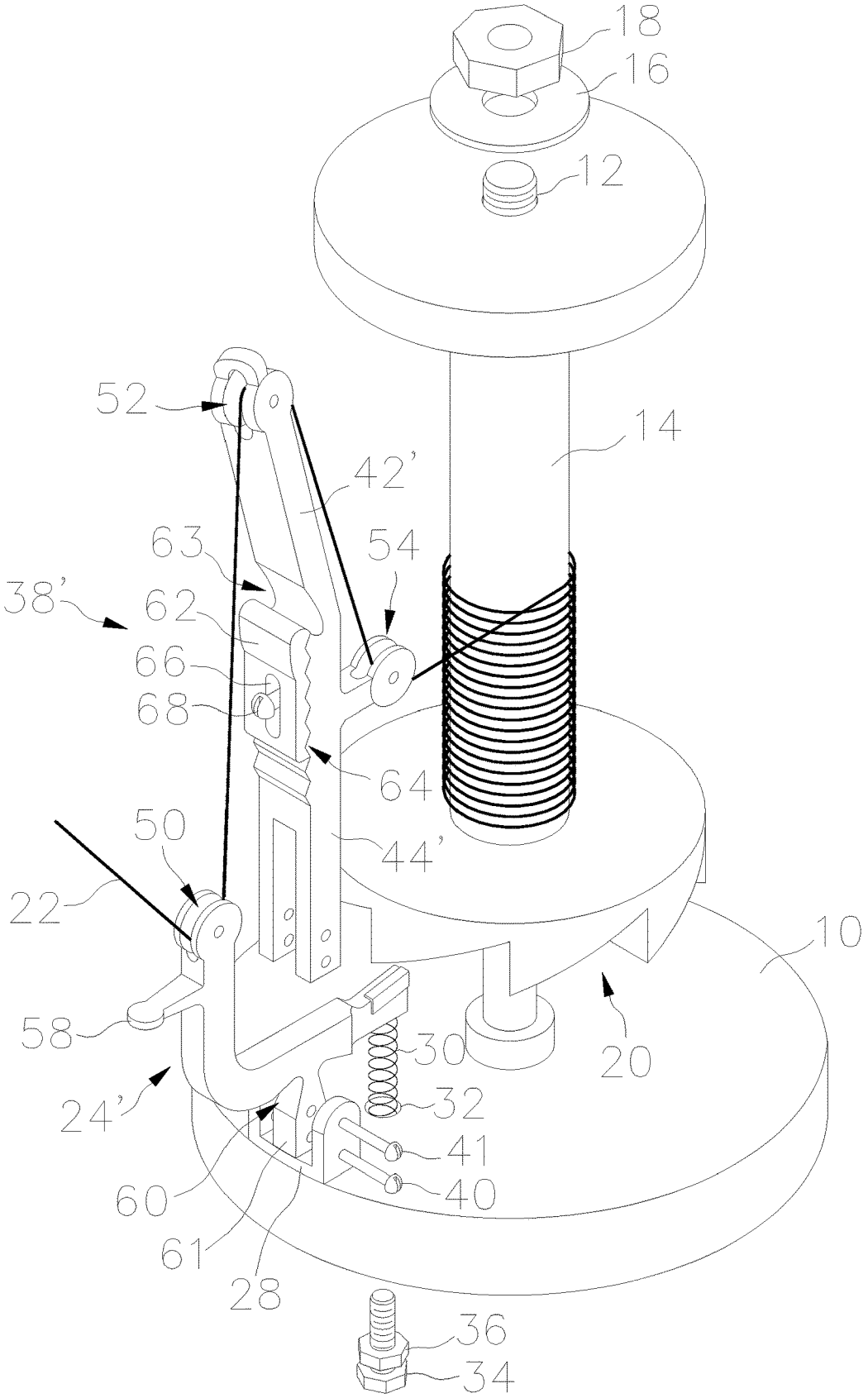
FIG. 2 is a perspective exploded view of a second embodiment of the yarn tensioning device according the present invention having a pawl jointed to the base via a flexural joint, and being equipped with a flexing compliant yarn guiding means.

FIG. 2 shows a second embodiment of the yarn tensioning device according to the present invention where pawl 24' performs a rocking motion by the means of a flexural hinge 60 which extends with a pedestal 61 that is mounted to base 10 via clevis 28 and screws 40 and 41.

The yarn tensioning device also includes a compliant yarn guiding means 38' consisting of a moving part 42' and a stationary part 44' jointed together via flexure hinge 63. Said complainant yarn guiding means 38' relies for its operation upon the elasticity of flexure hinge 63, and upon a preexisting outward bend of moving part 42'. For the purpose of adjusting the amplitude of the deflection of moving part 42', the compliant yarn guiding means 38' further includes a stopper 62. Said stopper assembles adjustably with stationary part 44' by means of a plurality of mating serrations 64, of a slotted hole 66 and a screw 68, said screw being threaded into stationary part 44' in a manner known to a person of ordinary skill in the art.

While preferred embodiments of the invention have been particularly described in the specification and illustrated in the accompanying drawing, it should be understood that the invention is not so limited. Many modifications, equivalents and adaptations of the invention will become apparent to those skilled in the art, without departing from the spirit and scope of the invention as defined in the following claims:

What is claimed is:

1. A yarn tensioning device capable to reel yarn off a spool at an adjustably preset tension comprising:

a base;

a center rod mounted perpendicular to the base;

a spool ending with a ratchet which together pivotally rotate about said center rod;

a pawl fitted with a flexural joint which allows said pawl to pivot relative to the base and engages said ratchet;

a pawl stiffening spring acting between the base and a tip of the pawl;

a compliant yarn guiding device comprising:

a stationary part; and a moving part jointed together via a second flexural joint, wherein an amount of deflection of the moving part is limited by the action of a stopper, the location of said stopper being modifiable by means of mating serrations, by the action of a screw which threads into the stationary part of said compliant yarn-guiding device, and by the use of a slotted hole along said stopper.

* * * * *